United States Patent [19]

Haas

[11] 4,125,119

[45] Nov. 14, 1978

[54] HIGH PRESSURE CLEANING DEVICE

[76] Inventor: Elwood L. Haas, Rte. #3, Bainbridge, Ga. 31717

[21] Appl. No.: 781,218

[22] Filed: Mar. 25, 1977

[51] Int. Cl.[2] ..... B08B 3/02

[52] U.S. Cl. ..... 134/100; 134/104; 134/191

[58] Field of Search ..... 134/99–104, 134/109–111, 186, 191, 172, 198, 199, 201

[56] References Cited

U.S. PATENT DOCUMENTS

| | | | |
|---|---|---|---|
| 1,266,167 | 5/1918 | Sears | 134/199 UX |
| 2,385,393 | 9/1945 | Wilson | 134/104 UX |
| 2,404,286 | 7/1946 | Graham | 134/104 UX |
| 2,675,012 | 4/1954 | Scales | 134/103 X |
| 2,721,566 | 10/1955 | Brucker | 134/111 X |

*Primary Examiner*—Robert L. Bleutge
*Attorney, Agent, or Firm*—Daniel Jay Tick

[57] ABSTRACT

A waste receptacle is provided at the bottom of a mobile, wheeled, open topped vessel. A suction pipe in the vessel is coupled to, and extends from, a water supply pipe into the vessel. A drain pipe extends from the vessel at the bottom thereof for draining water from the vessel. A motor driven pump and a plurality of valves mounted on the outside of the vessel selectively apply the pump to the pipes whereby in one valve operation the pump supplies water via the water supply pipe under pressure and the output of the nozzle cleans the surface of an item onto which it is directed in the vessel so that material removed from the item is collected in the waste receptacle, and in another valve operation, the pump draws water or water mixtures from the vessel through the suction pipe and discharges under pressure via a high pressure hose and nozzle. In another valve operation, the pump draws water from the water supply and discharges it under high pressure via a high pressure hose for external cleaning.

2 Claims, 3 Drawing Figures

FIG.1
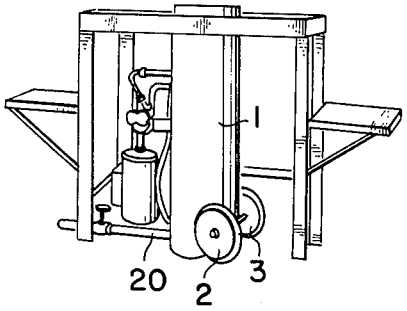
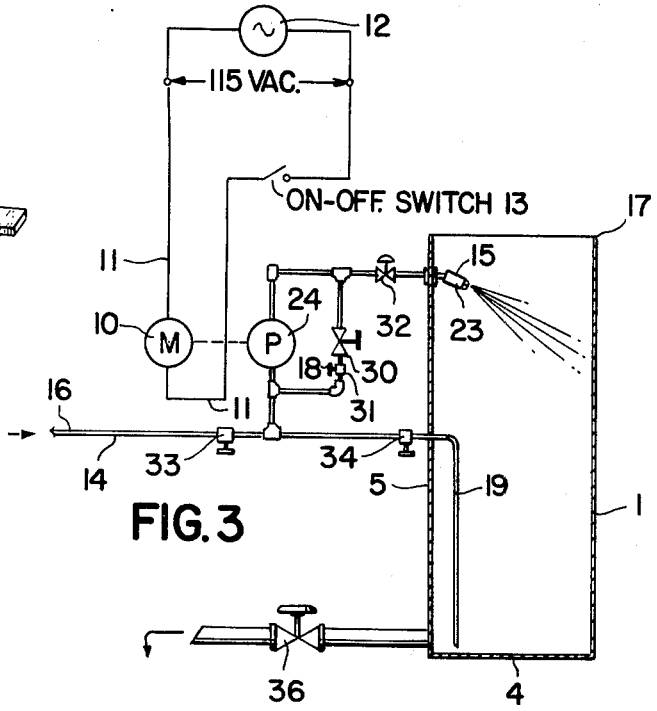
FIG.3
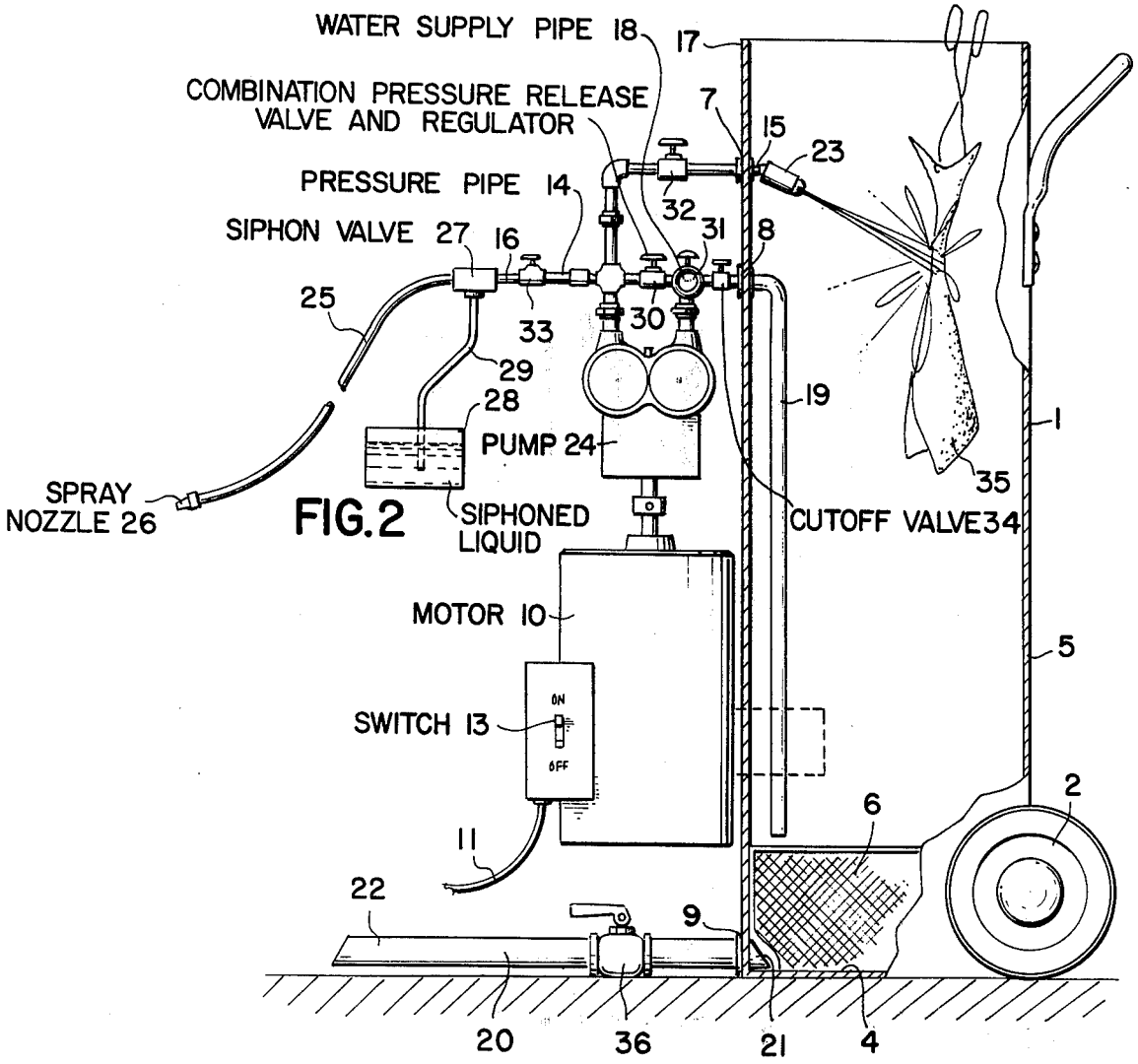
FIG.2

HIGH PRESSURE CLEANING DEVICE

BACKGROUND OF THE INVENTION

The present invention relates to a high pressure cleaning device.

Objects of the invention are to provide a high pressure cleaning device of simple structure, which is inexpensive in manufacture, used with facility, convenience and safety at any place having a water supply and a source of electrical energy available, and functions efficiently, effectively and reliably to thoroughly and properly clean any desired item such as, for example, a dirty paint brush, a painted item which it is desired to be repainted after loose particles of the initial coat are removed, hardware of all types, and the like.

BRIEF DESCRIPTION OF THE DRAWINGS

In order that the invention may be readily carried into effect, it will now be described with reference to the accompanying drawings, wherein:

FIG. 1 is a perspective view of an embodiment of the high pressure cleaning device of the invention;

FIG. 2 is a view, on an enlarged scale, partly cut away and partly in section, of the embodiment of FIG. 1, without the table type stand; and FIG. 3 is a circuit diagram of the electrical system of the high pressure cleaning device of the invention.

DETAILED DESCRIPTION OF THE INVENTION

The high pressure cleaning device of the invention comprises an open topped vessel 1 (FIGS. 1 to 3) having wheels 2 and 3 rotatably affixed thereto whereby said vessel is mobile (FIG. 1). The vessel 1 has a bottom 4 and sides 5 (FIGS. 2 and 3).

A waste receptacle 6 is provided in the vessel 1 at the bottom 4 thereof, as shown in FIG. 2, for collecting waste cleaned from an item in the vessel.

A plurality of spaced bores 7, 8 and 9 (FIG. 2) are formed through the side 5 of the vessel.

An electric motor 10 of any suitable type is mounted on the side 5 of the vessel and has electrical conductors 11 connected thereto and extending therefrom for connection to a source of electrical energy 12 (FIGS. 2 and 3). The motor 10 is connected to the source of electrical energy 12 via an ON-OFF switch 13 of any suitable type (FIGS. 2 and 3).

A pressure pipe or water pressure pipe 14, also referred to herein as a water supply pipe, has spaced opposite first and second ends 15 and 16 (FIGS. 2 and 3). The pressure pipe 14 extends into the vessel 1 via the bore 7 in a manner whereby the first end 15 of said pipe is inside said vessel near the open top 17 of said vessel. The second end 16 of the pressure pipe 14 is spaced from the vessel for connection to a high pressure hose for external cleaning.

A water supply pipe or line 18 is connected to the pressure pipe 14 and extends into the vessel 1 via the bore 8 thereof (FIG. 2).

A suction pipe 19 in the vessel 1 is coupled to, and extends from, the water supply pipe 18 into proximity with the waste receptacle 6 in the vessel via the bore 8, as shown in FIGS. 2 and 3.

A drain pipe 20 (FIGS. 1 to 3) has spaced opposite first and second ends 21 and 22 (FIG. 2). The drain pipe 20 extends into the vessel 1 via the bore 9 in a manner whereby its first end 21 is inside the vessel at the bottom

4 thereof. The second end 22 of the drain pipe 20 is spaced from the vessel 1 for draining water from said vessel.

A nozzle 23 is mounted on the first end 15 of the pressure pipe 14 in the vessel, as shown in FIGS. 2 and 3.

A pump 24 of any suitable type is mounted on the motor 10. The pump 24 is coupled to, and driven by, the motor 10, as shown in FIGS. 2 and 3.

A flexible high pressure hose 25 is coupled to the second end 16 of the pressure pipe 14 and has a high pressure spray nozzle 26 affixed to its free end. The hose 25 is coupled to the pressure pipe 14 via a siphon valve 27. The siphon valve 27 siphons liquid from a container 28 via a siphon tube 29 (FIG. 2).

A plurality of valves 30, 31, 32, 33, and 34 (FIGS. 2 and 3) are mounted in the water pressure, water supply and suction pipes 14, 18 and 19, respectively, for selectively applying the pump 24 to said pipes. Thus, in one valve operation, the valves 33 and 34 are is closed and the valves 31 and 32 are open, and the pump 24 supplies water under pressure via the water pressure pipe 14 and the water supply pipe 18 to the nozzle 23. The water is ejected from the nozzle 23 in a concentrated stream at very high pressure and therefore functions to clean the surface of an item 35 onto which the water is directed in the vessel 1 (FIG. 2). Material removed from the item 35 is collected in the waste receptacle 6 whereby it may be removed with facility.

In another valve operation, the end 16 of the water supply pipe is disconnected from the source of water supply and the valves 31 and 32 are closed, while the valves 33 and 34 are open. The pump 24 then draws water or water and waste material from the vessel 1 out through the suction pipe 19, the water pressure pipe 14 and the hose 25.

The siphon valve 27 is provided in the water pressure line 14 for selective siphoning of liquid from the container 28.

In another valve operation, the valves 32 and 34 are closed and the valves 31 and 33 are open. The water supply pipe 18 then supplies water to the pump 24 and high pressure water is then discharged through the pressure pipe 14, hose 25 and nozzle 26 for external pressure cleaning.

An additional valve 36 is provided in the drain pipe 20 for selectively draining water from the vessel 1.

The valve 30 is a combination pressure release valve and regulator.

While the invention has been described by means of a specific example and in a specific embodiment, I do not wish to be limited thereto, for obvious modifications will occur to those skilled in the art without departing from the spirit and scope of the invention.

I claim:

1. A high pressure cleaning device, comprising an open topped vessel having wheels rotatably affixed thereto whereby said vessel is mobile, said vessel having a bottom and sides;

a waste receptacle in the vessel at the bottom thereof for collecting waste cleaned from an item in the vessel;

a plurality of spaced bores formed through the side of the vessel;

an electric motor mounted on the side of the vessel and having electrical conductors connected thereto and extending therefrom for connection to a source of electrical energy;

a water pressure pipe having spaced opposite first and second ends, said water pressure pipe extending into the vessel via one of the bores therethrough in a manner whereby its first end is inside said vessel near the top thereof, the second end of the water pressure pipe being spaced from the vessel;

a water supply pipe connected to the water pressure pipe and extending into the vessel via another of the bores therethrough;

a suction pipe in the vessel coupled to and extending from the water supply pipe into proximity with the waste receptacle in the vessel via the other of the bores through said vessel;

a drain pipe having spaced opposite first and second ends, said drain pipe extending into the vessel via still another of the bores therethrough in a manner whereby its first end is inside the vessel at the bottom thereof, the second end of the drain pipe being spaced from the vessel for draining water from the vessel;

a nozzle on the first end of the water pressure pipe in the vessel;

a pump mounted on the motor and coupled to and driven by the motor; and a plurality of valve means in the water pressure and suction pipes for selectively applying the pump to said pipes whereby in one valve operation said pump supplies water under pressure via the water supply and water pressure pipes to the nozzle and the output of the nozzle cleans the surface of an item onto which it is directed in the vessel and material removed from the item is collected in the waste receptacle, and in another valve operation said pump draws water and water mixtures from the vessel out through the suction pipe, the water pressure pipe, the high pressure hose and another nozzle.

2. A high pressure cleaning device as claimed in claim 1, further comprising additional valve means in the drain pipe for selectively draining water from the vessel.

* * * * *